United States Patent [19]

Taylor et al.

[11] Patent Number: 5,038,865

[45] Date of Patent: Aug. 13, 1991

[54] METHOD OF AND APPARATUS FOR PROTECTING DOWNHOLE EQUIPMENT

[75] Inventors: William M. Taylor; Joseph H. Hynes; David H. Theiss, all of Houston, Tex.

[73] Assignee: Cooper Industries, Inc., Houston, Tex.

[21] Appl. No.: 458,951

[22] Filed: Dec. 29, 1989

[51] Int. Cl.[5] ..... E21B 33/04

[52] U.S. Cl. ..... 166/387; 166/182; 166/208; 277/206 R; 277/227

[58] Field of Search ..... 166/236, 363, 364, 350, 166/387, 208, 242, 182; 277/206 R, 227, 9, 228, 235 R; 285/39, 315, 321, 322, 910

[56] References Cited

U.S. PATENT DOCUMENTS

| | | | |
|---|---|---|---|
| 3,767,211 | 10/1973 | Amphlett | 277/1 |
| 4,593,448 | 6/1986 | Ferrari Aggradi et al. | 29/523 |
| 4,662,663 | 5/1987 | Schmitz | 285/382.5 |
| 4,768,275 | 9/1988 | Schmitz | 29/407 |
| 4,823,871 | 4/1989 | McEver et al. | 166/182 |
| 4,869,319 | 9/1989 | Szymozak et al. | 166/115 |
| 4,869,535 | 9/1989 | Breese | 285/39 |
| 4,887,846 | 12/1989 | Chin et al. | 285/18 |

*Primary Examiner*—Hoang C. Dang

[57] ABSTRACT

A method and apparatus for the protection of downhole equipment from excessive pressure conditions which includes providing structures of volume compensating material which are designed to resist normal pressures expected in the well bore. One form of the invention has a plurality of half sections of volume compensating material positioned around one of the tubular member in the annulus which has fluids that can increase in pressure to a point approaching damage to the interior of exterior member of the annulus. In another application a resilient seal includes a recess into which a ring of volume compensating material is placed to allow a place for fluids to flow when they are subjected to overpressure conditions.

2 Claims, 5 Drawing Sheets

METHOD OF AND APPARATUS FOR PROTECTING DOWNHOLE EQUIPMENT

BACKGROUND

The present invention relates to an improved method of and apparatus for the protection of well components from damage due to being exposed to excessive pressure resulting from the downhole environment in which they are to operate.

U.S. Pat. No. 4,662,663 discloses the use of a volume compensating material on the interior of a first tubular member which is to have a second tubular member pressure formed into a grooved surface on the interior of the first tubular member at an underwater location. The volume compensating material is utilized to exclude water from the grooves so that it will not create a hydraulic lock preventing proper deformation of the second tubular member into sealing and gripping engagement within the grooves on the interior of the first tubular member. One material suggested for this volume compensating material is a plurality of microspheres held in an epoxy matrix.

This type of material is designed to function to cause the microspheres to rupture upon the application of pressure and allow the entry therein of any trapped liquid and to crush at excessive forming pressures to thereby allow the completion of the pressure forming. Another reference making similar suggestions is U.S. Pat. No. 4,593,448.

A recently issued U.S. Pat. No. 4,869,535 discloses the use of such volume compensating material in a downhole environment, particularly in an annular chamber into which an annular piston moves responsive to pressure. In this patent the volume compensating material functions to exclude fluids which might prevent the desired movement of the piston and allows such movement by the crushing of the material responsive to the pressure force exerted thereon by the pressured piston.

SUMMARY

The present invention relates to an improved method of and apparatus for protecting downhole equipment from damage caused by changes in the environment of the well in which they are positioned, in the downhole location. It involves the use of a volume compensating material which is preselected to resist the normal hydrostatic pressure of the downhole location to which it is exposed, but when conditions at the downhole location change, such as an increase in pressure above the normal hydrostatic pressure which would result from temperature increases of the fluid confined in the annulus from the heating of the liquid by the well fluids flowing thereby from lower depths of the well, such material functions to allow volume changes which prevent pressure increases that would damage the downhole equipment. The apparatus includes the use of a preselected volume compensating material in surrounding relation to a well string which is positioned within a well and is surrounded by another string with well fluids contained in the annulus between the two strings. Another form of apparatus is the inclusion of a preselected volume compensating material in the surface of a resilient well string seal between upper and lower metal lip seals to protect the resilient seal from being subjected to excessive pressure which could create pressures releasing the metal lip seals or cause the resilient seal to be extruded from its desired sealing position.

An object of the present invention is to provide an improved method of and apparatus for protecting downhole well equipment from damage which could result from overpressure conditions arising as a result of the environment in the downhole well position.

Another object is to provide an improved method of an apparatus for protecting downhole well equipment from pressure increases resulting from the confinement of the downhole location and the heating of fluids therein.

Still another object is to provide an improved method of and apparatus for protecting downhole well equipment from conditions which vary at the downhole location and which is relatively simple and inexpensive.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENTS

Figure 1:
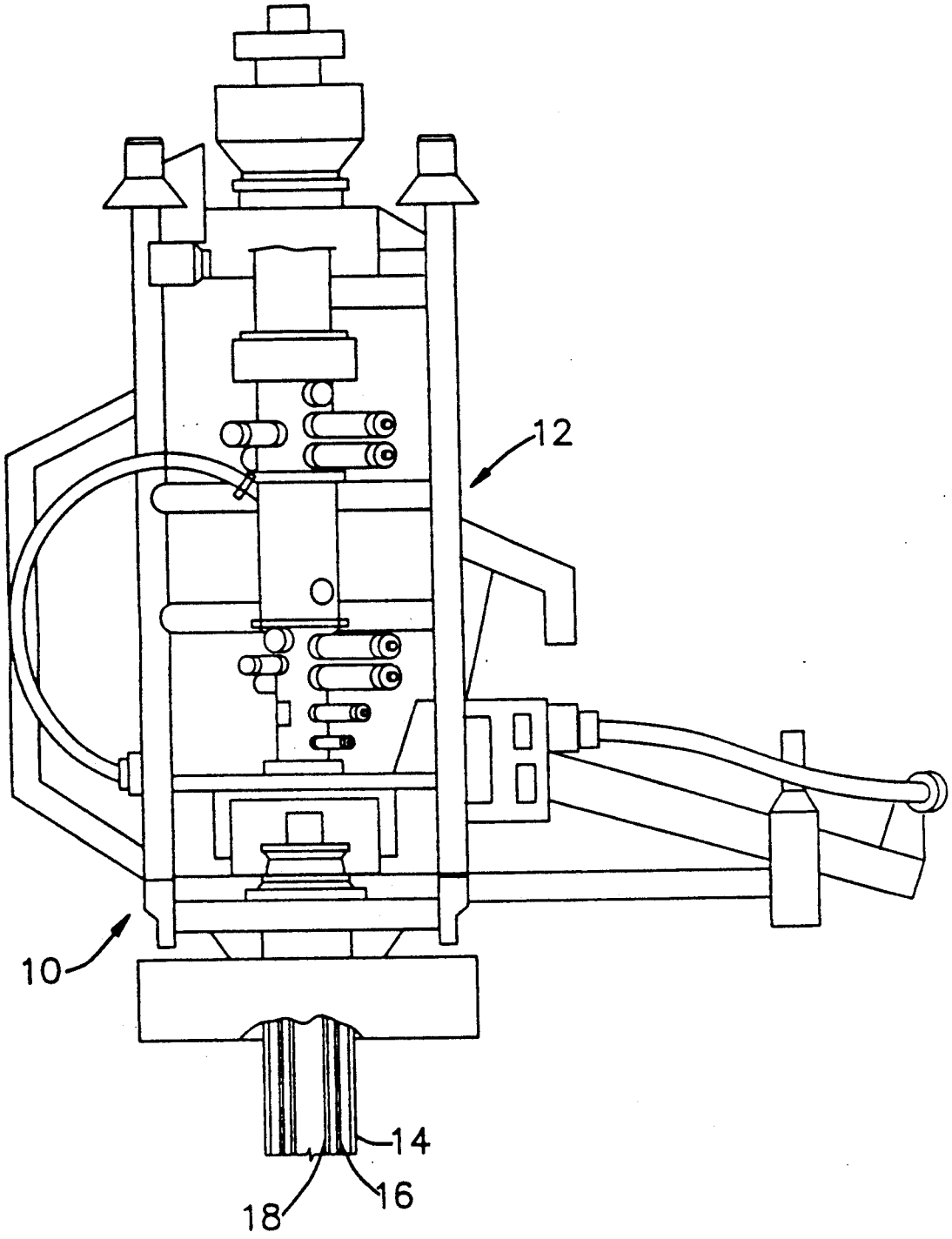
FIG. 1 is an elevation view of a subsea well illustrating the environment to which the present invention applies.

As shown in FIG. 1, a subsea well 10 is illustrated and includes the usual wellhead production equipment 12 with outer wellhead casing 14 extending downward in well 10. Casing string 16 is positioned within wellhead casing 14 and extends downwardly therein as shown. Within casing string 16, string 18, which is a production string, extends downwardly within casing string 16 and the present invention is provided in surrounding relationship to either casing string 16 or string 18 to protect them from physical damage as a result of an increase in the pressure conditions in the annulus which conditions are above those pressures normally expected as a result of the head of liquid under which they operate. Such conditions can result from the production of hot production fluids which cause the annulus fluids surrounding the production string 18 to become heated and in the normal subsea production equipment, the added heating of the annulus fluids creates an increase in the pressure in the annulus since such equipment does not have any way in which to vent the annulus short of reworking the wellhead production unit.

Figure 2:
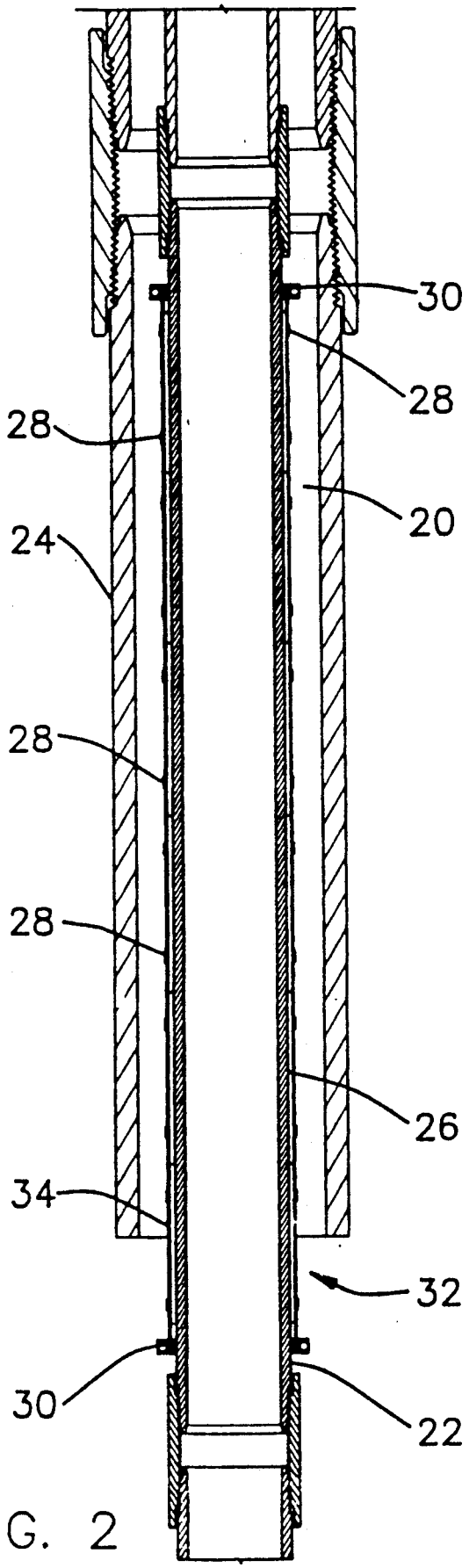
FIG. 2 is a sectional view of the well illustrating the improved apparatus of the present invention as applied to a string in the downhole environment illustrated in FIG. 1.
Figure 2A:
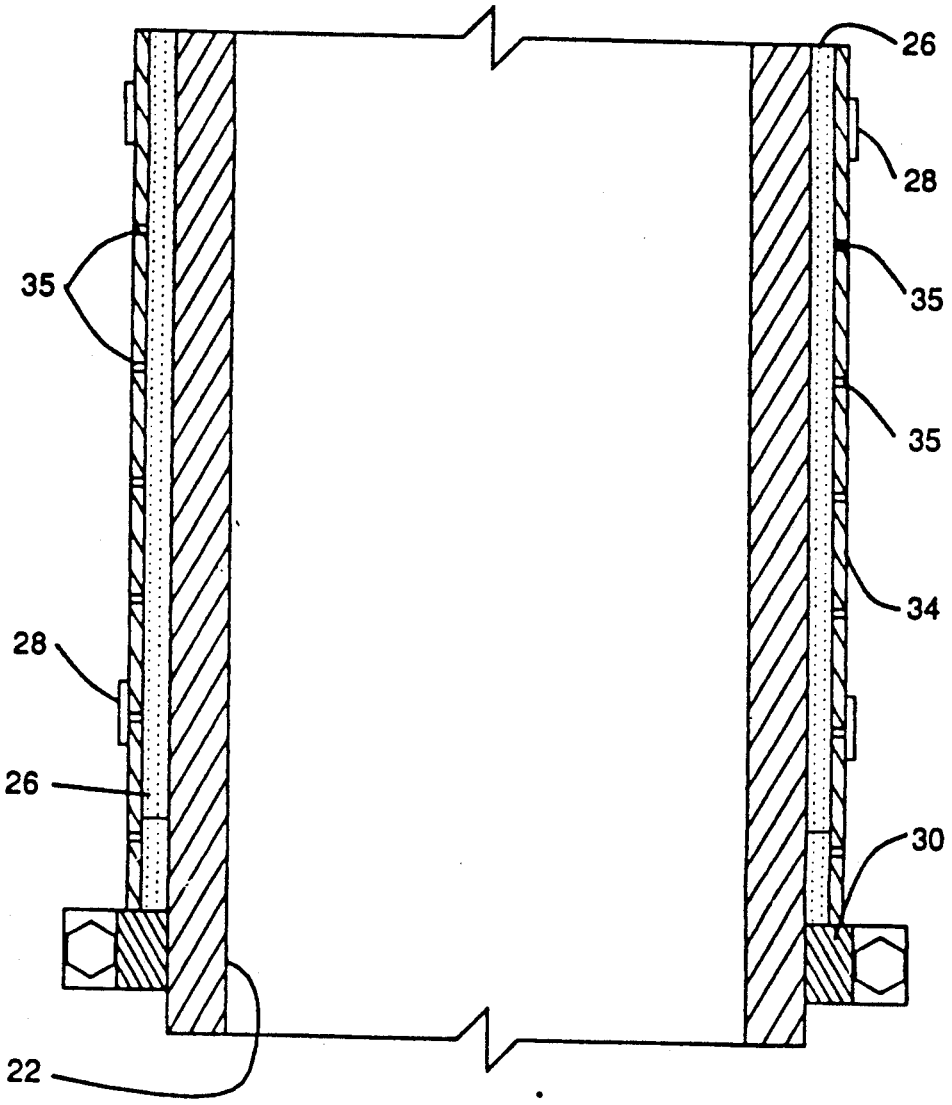
FIG. 2A is an enlarged detail sectional view of a portion of the inner string to which the improved apparatus of the present invention has been applied as shown in FIG. 2.

In solving this problem of compensating for the increase in pressure in the annulus 20 resulting from the heating, either from the production fluids or other sources in the well, it is preferred to provide a volume compensating material positioned in the annulus having sufficient collapsible volume to prevent an increase of the annulus pressure to a damaging level. It should be noted that excessively high annulus pressures may damage either the interior string 22 or the exterior string 24 or both. As shown in FIG. 2 and 2A, it is preferred that the volume compensating material be provided on the exterior of the interior string 22 and is applied in half cylindrical sections 26 which are held in surrounding relationship to interior string 22 by bands 28. End bands 30 are positioned around the upper and lower ends of the uppermost and the lowermost half sections to secure the sections in their desired position longitudinally on the section 32 of the interior string 22. Skin 34 is positioned on the exterior of half sections 26 and is provided to protect half sections 26 during the lowering of interior string 22 into position. It should be noted that skin 34 may be a metal sheath or a plastic skin which protects the volume compensating half sections 26 from damage during lowering of string 22. Further skin 34 should be porous or have sufficient openings or pores 35 therein to allow ready access of the annulus fluids to the interior of the volume compensating material. Generally, the preferred volume compensating material for use in the present invention is microspheres in an epoxy matrix with the material being selected to withstand the normally expected annulus pressures to which it will be exposed. The pressure rating of such materials is readily achieved by known methods. It should be understood that any other suitable type of volume compensating material which can be provided with a suitable structure to withstand the normally expected annulus pressures and still have substantial volume reduction responsive to excessive pressure to cause such pressure to be reduced and preventing them from causing damage to either of the strings forming the inner and outer boundaries of the annulus may be provided.

With the volume compensating material half sections 26 positioned as shown in FIG. 2 and 2A, any substantial increase in the temperature of the fluids in annulus 20 will cause the pressure to increase above the predetermined maximum desired pressure to be contained in annulus 20. With the volume compensating half sections 26 being exposed to the fluids at such pressure the microspheres will start to rupture providing a volume for the fluids from which they had previously been excluded and thus, reduce the pressure within annulus 20 to the level of the preselected maximum desired pressure. Since half sections 26 have the capability of greatly increasing the available volume for the annulus fluids, the bursting of the microspheres due to overpressure will cause a corresponding increase in volume and the consequent reduction of pressure.

Figure 3:
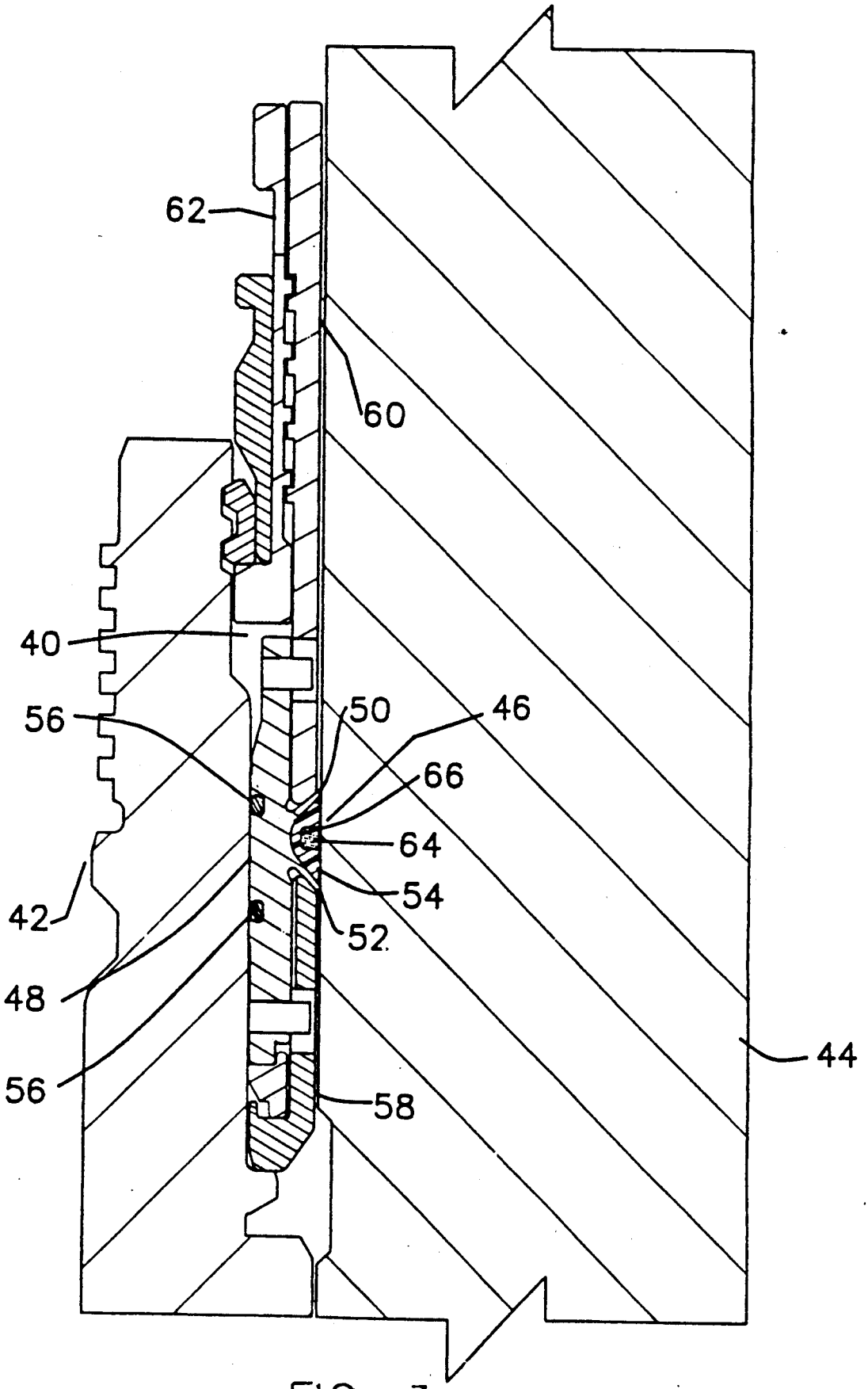
FIG. 3 is a sectional view of an improved annulus seal having both upper and lower metal lip seals and an intermediate resilient seal with the invention incorporated therein.
Figure 4:
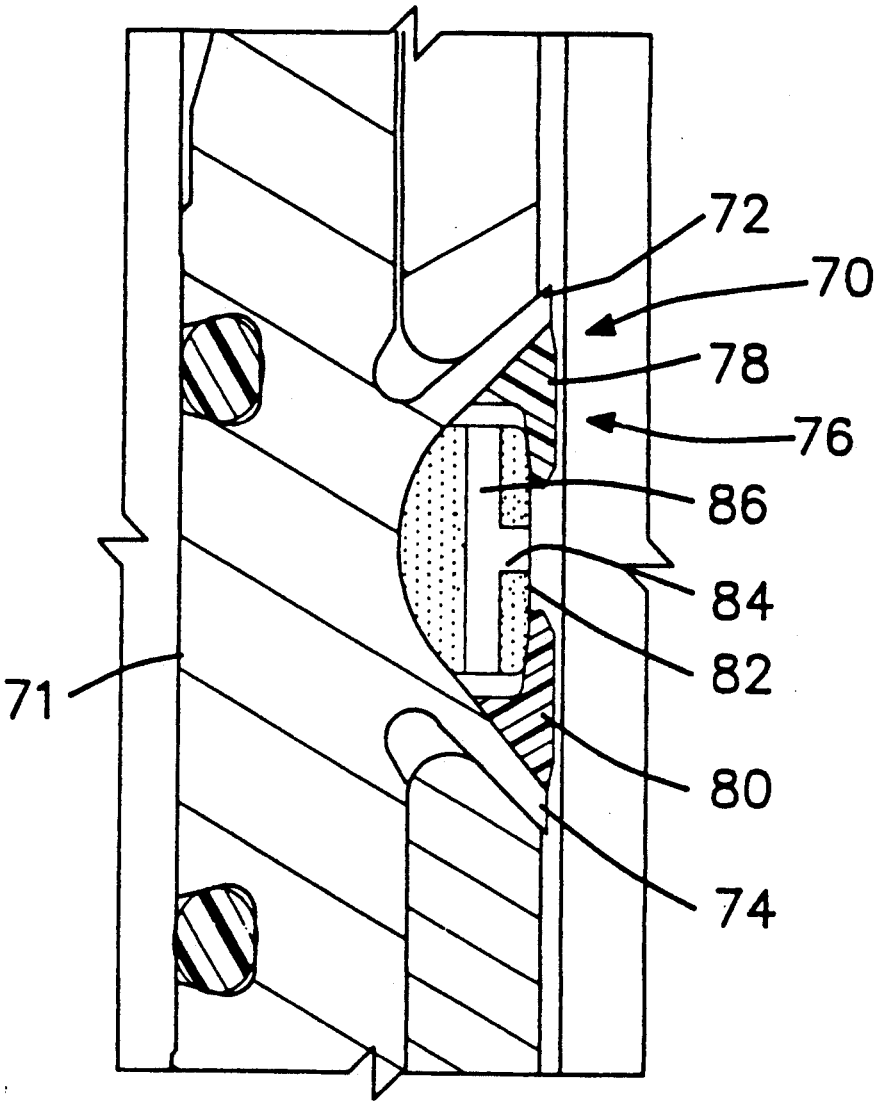
FIG. 4 is another sectional view of a modified form of the seal shown in FIG. 3.

Another application of the present invention is to an annulus seal as illustrated in two embodiments shown in FIGS. 3 and 4. Annulus 40 is between the exterior surface of inner tubular member 42 and the interior surface of outer well member 44. Seal assembly 46 is lowered into position in annulus 40. Seal assembly 46 includes seal body 48 having outer diverging lips 50 and 52 with resilient seal 54 between lips 50 and 52 and a suitable inner seal such as seal rings 56, lower setting ring 58 supported from body 48 and movable with respect thereto, upper setting ring 60 which is supported from and movable with respect to body 48 and actuator 62 which can be rotated to cause setting rings 58 and 60 to be moved toward each other to cause lips 50 and 52 to move outward to their set position. Resilient seal 54 is of a suitable resilient material which is impervious to the well fluid encountered in annulus 40. Ring 64 of volume compensating material is positioned in groove 66 in the exterior of resilient seal 54. It is preferred that the material of ring 64 be such that any fluids trapped between lips 50 and 52 after they are set will cause collapse of the material, such as the collapse of microspheres in the preferred materials, to prevent the generation of excessive pressures resulting from a heating of the fluids or from other reasons causing such pressure increase.

A modified form of annulus seal is illustrated in FIG. 4 wherein seal assembly 70 includes a structure similar to seal assembly 46 including body 71 with external diverging lips 72 and 74 with resilient seal 76 includes upper ring 78 and lower ring 80 between lips 72 and 74. Ring 82 of volume compensating material is positioned in a space between upper ring 78 and lower ring 80. Ring 82 includes a plurality of radial passages 84 communicating from the exterior of ring 78 to axial passages 86. Passages 84 and 86 are provided to ensure that the fluids trapped between lips 72 and 74 have access to the collapsed microspheres when an excessive pressure has been encountered.

The volume compensating material used with the annulus seals is preferred to be the microspheres in an epoxy matrix previously described with reference to cylindrical half sections 26.

What is claimed is:

1. The method of protecting well equipment from abnormal pressures in a downhole location including the steps of securing a volume compensating material to a portion of the well equipment so that the volume compensating material is exposed to well pressures at the downhole location, said well equipment including an annular seal having an upper metal seal lip, a lower metal seal lip and an intermediate resilient seal ring with a recess in the exterior surface of the resilient seal ring.

said volume compensating material being structured for providing sufficient resistance to withstand normal head pressures within the downhole location but allowing rupture responsive to pressures above such normal head pressures, said volume compensating material is provided in the recess in the surface of the resilient seal ring, and lowering the well equipment in the well to the downhole location.

2. An apparatus for protecting well equipment from abnormal pressures in a downhole location comprising a body forming a part of the well equipment and having a surface exposed to well fluids in a downhole location, said body including an annular seal having an upper metal seal lip and a lower metal seal lip and an intermediate resilient seal ring with a recess in the exterior surface of the resilient seal ring, an annular ring of volume compensating material positioned on the body surface exposed to well fluids, and said volume compensating material is installed in the resilient seal recess, said volume compensating material having a means for providing sufficient resistance to sustain normal head pressures at the downhole location while allowing volume changes responsive to abnormal pressures at the downhole location.

* * * * *